US006135399A

United States Patent [19]

Savoie et al.

[11] Patent Number: 6,135,399

[45] Date of Patent: Oct. 24, 2000

[54] WRIST RELAXER FOR COMPUTER KEYBOARDS AND OTHER EQUIPMENT REQUIRING REPETITIVE HAND OPERATION

[76] Inventors: Roland K. Savoie, 17 Finca, San Clemente, Calif. 92672; Paul J. Savoie, 103 E. Sierra Madre Blvd., Unit B, Sierra Madre, Calif. 91024

[21] Appl. No.: 09/133,739

[22] Filed: Aug. 13, 1998

Related U.S. Application Data

[63] Continuation-in-part of application No. 08/841,925, Apr. 8, 1997, abandoned.

[51] Int. Cl.[7] ..... B68G 5/00

[52] U.S. Cl. ..... 248/118; 248/918; 600/15

[58] Field of Search ..... 248/118, 118.1, 248/118.3, 118.5, 918; 400/715; 600/15, 9; 601/15, 49

[56] References Cited

U.S. PATENT DOCUMENTS

| | | | |
|---|---|---|---|
| 4,330,892 | 5/1982 | Fukushima | 600/15 X |
| 4,481,556 | 11/1984 | Berke et al. . | |
| 4,482,063 | 11/1984 | Berke . | |
| 4,482,064 | 11/1984 | Berke . | |
| 5,050,826 | 9/1991 | Johnston | 248/118.3 |
| 5,120,010 | 6/1992 | Magee | 248/118 |
| 5,342,005 | 8/1994 | Szmanda . | |
| 5,342,006 | 8/1994 | Tice . | |
| 5,416,498 | 5/1995 | Grant . | |
| 5,429,585 | 7/1995 | Liang | 600/9 X |
| 5,467,950 | 11/1995 | Dumitru | 248/118.1 |
| 5,478,034 | 12/1995 | Cunningham et al. | 248/118.5 |
| 5,599,280 | 2/1997 | Wolden | 601/15 |
| 5,686,005 | 11/1997 | Wright, Sr. | 601/15 X |
| 5,813,971 | 9/1998 | Broderick | 600/15 |
| 5,826,841 | 10/1998 | Lavore | 248/118 |
| 5,951,459 | 9/1999 | Blackwell | 600/15 X |
| 5,971,331 | 10/1999 | Getsay | 248/118 |
| 6,048,303 | 4/2000 | Porter | 600/15 |

*Primary Examiner*—Ramon O. Ramirez
*Assistant Examiner*—Gwendolyn Baxter
*Attorney, Agent, or Firm*—Gene Scott-Patent Law & Venture Group

[57] ABSTRACT

A forearm, wrist and hand support apparatus, with rotatable rollers, for operators of, and to be used with computer keyboards, calculators, computer mice and other equipment requiring repetitive hand operation. Said apparatus (relaxer) is comprised of two sets of round, rotatable rollers 16, 16A and 16B, and 18, 18A and 18B for equipment requiring two hand-operation, and one set of round, rotatable rollers 22, 22A and 22B, for equipment requiring one-hand operation. The operator can rest his/her hand(s) while pausing during the input process, and need only move his/her wrist(s) and hand(s) on the round (cylindrical) rollers during the input process thus creating a massaging action. The use of said wrist relaxer will help maintain the operator's shoulder(s), arm(s), wrist(s) and hand(s) in a healthy condition.

1 Claim, 2 Drawing Sheets

WRIST RELAXER FOR COMPUTER KEYBOARDS AND OTHER EQUIPMENT REQUIRING REPETITIVE HAND OPERATION

This is a continuation-in-part of Application Ser. No. 08/841,925 filed on Apr. 8, 1997 now abandoned.

BACKGROUND

1. Field of Invention

This invention relates to a rotatable support apparatus for an operator's forearms, wrists and hands, and said apparatus is used generally with computer keyboards, computer mice, calculators and other equipment requiring repetitive hand operation.

2. Description of Prior Art

Extensive use of computer equipment has caused shoulder, arm, wrist and hand problems for the operators.

Originally there was no support for the operator's forearms, wrists and hands when operating this equipment thus causing pain and injuries to some of these operators during extensive use.

Thereafter, inventors created several types of stationary keyboard arm rests to prevent limb damage.

U.S. Pat. No. 5,416,498 to Grant (1992) discloses two stationary keyboard surfaces for supporting the palms of the operator as the fingers contact keys on the keyboard. However, there is friction to the operator's wrists and palms created by the movement of the operator's fingers traversing up and down the keyboard during use.

U.S. Pat. No. 5,342,005 to Szmanda (1992) offers an arm support assembly which is a stationary type of support subject to friction when the operator's arms move across the forearm supports.

U.S. Pat. No. 5,342,006 to Tice (1993) shows a stationary desk-fittable arm rest subject to friction when used.

U.S. Pat. No. 4,482,063 (1980), U.S. Pat. No. 4,482,064 (1981) and U.S. Pat. No. 4,483,556 (1980), all three to Berke, show various terminal supports with stationary hand rests for supporting the hands of the computer terminal operator only during periods of non-use of the computer terminal.

Microsoft Company is currently selling a "Natural" keyboard with resting places for the hands during periods of non-use. (patent, if any, unknown).

There are also generic foam rubber wrist pads available to rest the wrists during periods of non-use of the keyboard. The Grant, Szmanda and Tice patents listed above that show arm, wrist, hand and palm supports to be used while typing on the computer keyboard are stationary-type rests which create friction to the operator's arms and hands as they move across the supports to reach the upper keys on the keyboard, and then back to the lower keys on the keyboard and/or the numerals on the right side. This also would tend to lower the operator's input speed.

The Berke patents listed above, the Microsoft "Natural" keyboard and the generic foam rubber wrist pads that assist the operator only during periods of non-use are of no benefit during periods of equipment use.

Accordingly, besides the objects and advantages of the rotatable forearm, wrist and hand support equipment described in our above patent, several objects and advantages of the present invention are:

(a) to provide a support apparatus with round rollers rotating on their axes, and as the hands move across them in both a forward and backward motion during the operational sequence, give full support to the forearm, wrist and hand areas of the operator. In addition, it alleviates shoulder stress to the operator.

(b) to provide a support apparatus with rotating motion of the round rollers to massage the forearms,wrists and hands of the operator thus lessening the fatigue factor and possible injuries to the limbs. This rotating motion during use also maintains the operator's forearms and wrists in an even, horizontal position at all times for proper wrist function, and would tend to prevent wrist damage.

(c) to provide a support apparatus that can also be used on calculators, computer mice, and other equipment requiring the use of only one hand by using only one set of round rollers, rotating on their axes, instead of two sets used on the computer keyboard or other equipment requiring the use of both hands.

(d) to provide a support apparatus that can be manufactured in various dimensions to accomodate all of the current keyboards on the market, and generally one size would fit most computer keyboards. Our rotatable, cylindrical/round wrist relaxers can be made an integral part of keyboards manufactured in the future.

Further objects and advantages of our invention will become apparent from a consideration of the drawings and ensuing description.

DRAWING FIGURES

In the drawings, identical parts have the same number but a different alphabetical suffix.

REFERENCE NUMERALS IN DRAWINGS

Figure 1:
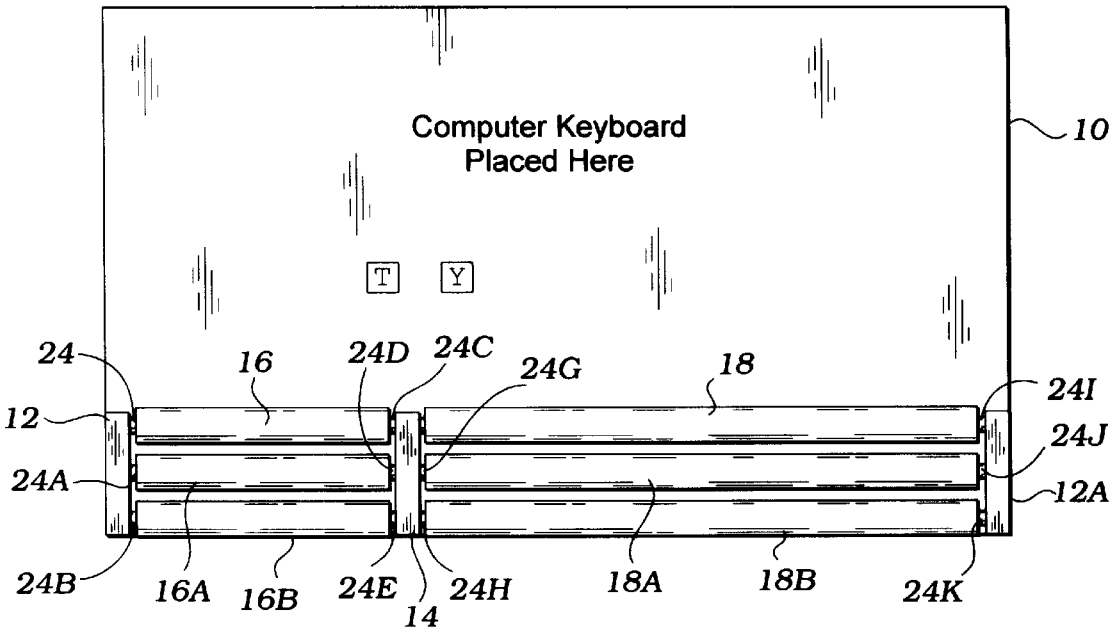
FIG. 1 is a top view of said wrist relaxer for computer keyboards.

10 base plate for computer keyboard use

12 side support for computer keyboard, calculator and mouse use

14 center support for computer keyboard use

16 left hand round (cylindrical) rollers for computer keyboard use

18 right hand round (cylindrical) rollers for computer keyboard use

20 base plate for calculator or computer mouse use

22 round (cylindrical) rollers for calculator or mouse use

24 metal washers, ⅜" I.D. for roller and support spacing

Description—FIGS. 1 to 6

Figure 2:
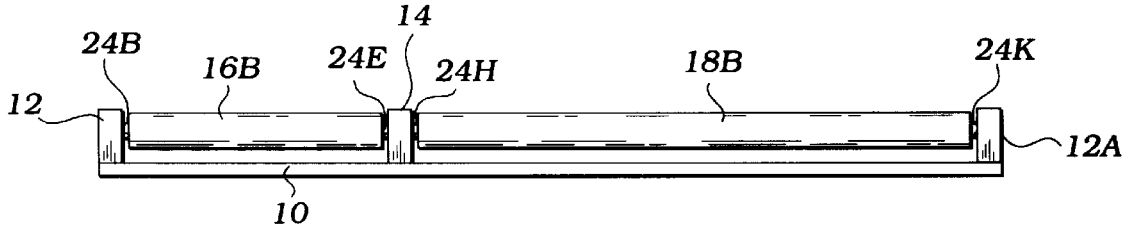
FIG. 2 is a front view of said wrist relaxer for computer keyboards.
Figure 3:
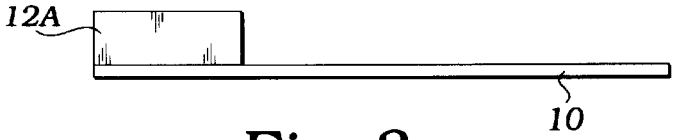
FIG. 3 is a side view of said wrist relaxer for computer keyboards.

A typical embodiment of our invention, a wrist relaxer for computer keyboards is shown in FIGS. 1, 2 and 3. Said relaxer is comprised of six rotatable round (cylindrical) rollers (three rotatable rollers for the left hand 16, 16A and 16B, and three rotatable rollers for the right hand 18, 18A and 18B). Each roller rotates on an axis (rod) located on said left 12, right 12A and center 14 supports. Said three left hand rollers shall start at the inside of said left side support 12, said support 12 being in line with the outer left side of the computer keyboard, and end at the left side of said center support 14; said center support 14 being in line with the letters T and Y on the computer keyboard. Left rollers 16, 16A and 16B average 5½ inches in length. Said right hand rollers 18, 18A and 18B shall start at the right side of said center support 14 and end at the inside of said right support 12A. Right rollers 18, 18A and 18B average 11½ inches in length. Said right hand support 12A shall be in line with the outer right side of the computer keyboard. Each roller shall have a ⅜-inch I.D. metal washer 24 on each end separating said rollers from the supports to assist the rotation operation.

The total dimension of the rollers including said supports approximates 19½ inches. Said dimension may vary to some extent (+ or −) if the computer keyboard used is of a different width.

Figure 4:
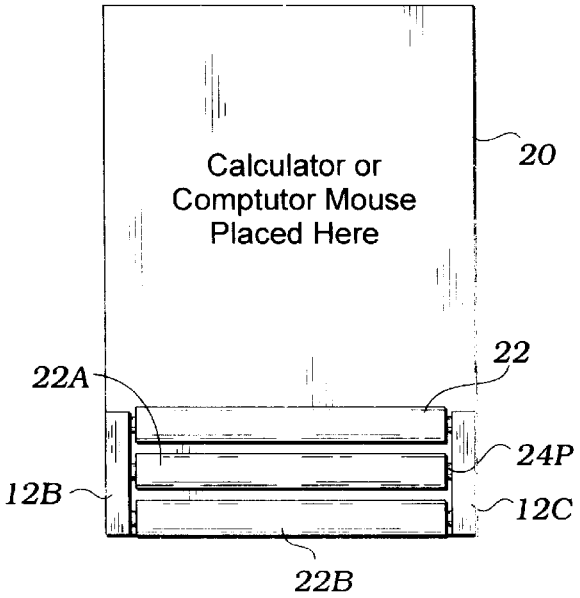
FIG. 4 is a top view of said wrist relaxer for calculators and computer mice.
Figure 5:
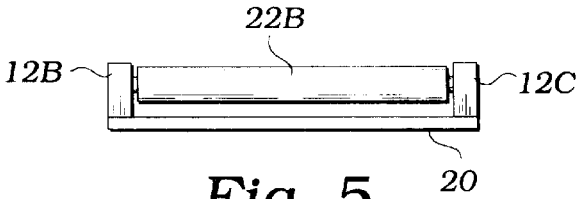
FIG. 5 is a front view of said wrist relaxer for calculators and computer mice.
Figure 6:
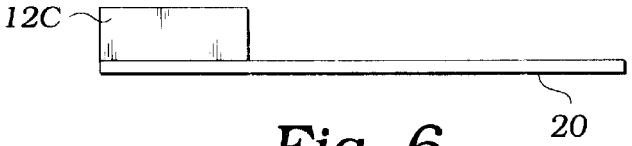
FIG. 6 is a side view of said wrist relaxer for calculators and computer mice.

FIGS. 4, 5 and 6 illustrate said wrist relaxer to be used for calculators, computer mice, and other equipment requiring one-hand operation. Said relaxer shall have a left hand side support 12B and a right hand side support 12C only, and the width shall conform to the width of the equipment being used. Most calculators average 8 inches in width. Minimum length of said rollers 22, 22A and 22B shall be 5½ inches to accomodate the operator's hand.

Said side supports 12, 12A and said center support 14 for the computer keyboard are affixed to said base plate 10.

Said side supports 12, 12A, 12B and 12C, and center support 14 contain protruding round rods used as axes for the cylindrical (round) rollers to rotate on when in use and such round rods may be attached to the end supports in any manner whatever, including being frictionally inserted in appropriate holes in the supports as would be known to those of skill in the art. Said side supports 12, 12A, 12B and 12C, and center support 14 are ⅝-inch thick by 1¼ inches high by 3 inches long. Said side supports 12, 12A, 12B and 12C have three protruding round rods on the inside facia of each support; said round rods are ¼-inch in diameter by 1 inch in length. Said rods can be formed as an integral part of said supports 12, 12A, 12B and 12C or can be made of metal inserts for longer life. Said center support 14 has the same size and type of round rods as the side supports but the rods are on both sides of the facia. Said rods are the axes for the cylindrical rollers. All of the cylindrical (round) rollers have ⅜-inch diameter round holes in each end, and these holes act as a receptacle for the rods for rotation capability.

Each roller shall have a ⅜-inch I.D. metal washer 24 on each end separating the roller from the supports to assist roller operation.

Said base plate 10 is typically ¼-inch in thickness, and will average 19½ inches in width but the length is dependent on the keyboard equipment being used. Most standard keyboards necessitate a base plate with an overall length of 12 inches.

Said base plate 20 is typically ¼-inch in thickness, and an average 8 inches in width but the length is dependent on the calculator or computer mouse being used. An 11-inch overall length will handle most calculators and mice.

Said cylindrical (round) rollers shall be typically ¾-inch in outside diameter but can be 1 inch in outside diameter or said wrist relaxer can have a set of four rollers for each hand if the operator has a longer than average arm.

The wrist relaxer can be manufactured of ABS plastic composition, the same material as used in computer keyboards, or various impregnated or laminated materials, or metal if preferred.

Operations—FIGS. 1 to 6

For computer use, the computer keyboard would be set on the back portion of said base plate 10 with the front edge of the keyboard resting against the back edge of said supports. 12 and 12A, and center support 14. The operator (user) would then rest his/her hands and wrists on said rollers in preparation for computer input. While the operator is inputing, his/her hands and wrists will move back and forth on said rotating rollers, giving the operator a massaging action to his/her wrists and hands which is beneficial for preventing arm, wrist and hand injury. The resting facet of our support apparatus during use and while pausing relieves most shoulder stress.

For calculator use, requiring only one-hand operation, the calculator would be set on the back portion of said base 20 with the front edge of the calculator resting against the back edge of said side supports 12B and 12C. For computer mouse use the front edge of the mouse would be set approximately 2 inches behind the back edge of said side supports 12B and 12C. The operator will then rest his/her hand and wrist on said rollers in preparation for use. While inputing, the operator's hand and wrist will move back and forth on said rotating rollers, giving the operator a massaging action to his/her wrist and hand thus preventing pain and injury to the limb.

Said rotatable wrist relaxers could be an integral part of future computer keyboards, calculators and mice manufactured thus negating the need for extended base plates.

Summary, Ramifications and Scope

Accordingly, the reader will see that said rotatable round (cylindrical) rollers of this invention can be used as a resting place for the wrist(s) and hand(s) while pausing during the input process on the computer, calculator or computer mouse. In addition, the operator need only move his/her wrist(s) and hand(s) over said rotatable round (cylindrical) rollers during the input process, and said rollers will gently massage the forearm(s), wrist(s) and hand(s). This massaging action will help maintain the operator's arms, wrists and hands in a healthy condition. The resting facet of our invention during use and while pausing relieves shoulder stress. Furthermore, our rotatable wrist support has the additional advantages in that

- it will cause minimal friction during input, especially when compared to the stationary arm rests currently patented, and will lessen the fatigue factor and increase input speed and accuracy;
- it also maintains the operator's forearm(s) and wrist(s) in an even, horizontal position at all times for proper wrist function;
- it can be made an integral part of future production of computer keyboards, calculators and mice.

Figure 7:
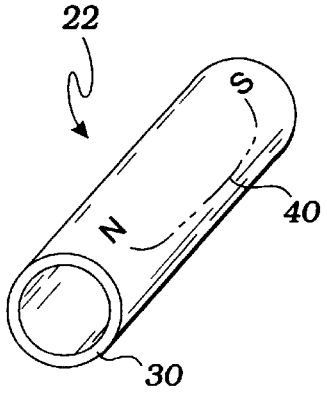
FIG. 7 is a perspective view of one of the rollers of the invention showing a magnetic cyclindrical covering with magnetic field lines running longitudinally along the roller.

In a preferred embodiment each of the rod shaped rollers 22 provides a cylindrical outer covering 30 containing a ferromagnetic material, the outer covering 30 being permanently magnetized so as to produce a static magnetic field having magnetic field lines 40 extending in longitudinal adjacency to the outer covering as shown in FIG. 7. The lateral sliding movements discussed above cause the arms, wrists and hands to move through the magnetic field gradient between a magnetic north N and a magnetic south S positions on the rollers 22 for therapeutic benefit.

Figure 8:
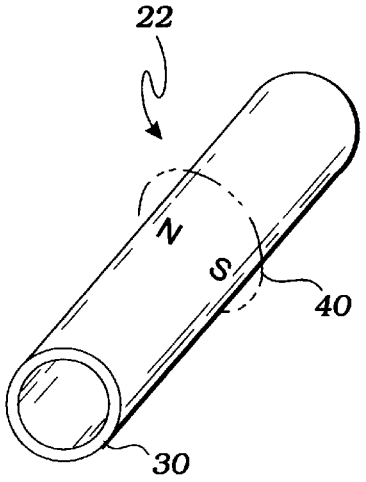
FIG. 8 is a perspective view of one of the rollers of the invention showing a magnetic cyclindrical covering with magnetic field lines running circumferentially around the roller.

In an alternate embodiment of the above magnetic field construction, shown in FIG. 8, each of the cylindrical outer coverings 30 is permanently magnetized so as to produce a static magnetic field having magnetic field lines 40 extending in circumferential adjacency to the outer covering 30 so that with the arms, wrists and hands in forward and backward thrusting movements they move through a magnetic field gradient between a magnetic north N and a magnetic south S positions on the rollers 22 for therapeutic benefit.

The outer covering is preferably an iron containing rubberized plastic as is well known for low strength magnetization and use as refrigerator mounted magnets of various shapes when formed in sheets. This well known material may be easily formed for the cylindrical coverings 30 on the rollers 22 of the present invention. Electromagnetic fields produced by AC currents are thought to be detrimental to flesh when brought into close contact or when used at high magnetization levels. The reason for this is believed to be the time rate of change of the magnetic fields and the frequency of such change, i.e., 60 Hz. On the other hand, static magnetic fields produced by permanent magnets are known to offer beneficial therapeutic results with low magnetizing levels and relatively slow evolution of magnetic field gradients as in the present case. Please note that AC magnetic fields reverse each 17 milliseconds, while with the most vigorous hand motion, field reversal of the permanent magnet fields mounted on the rollers of the instant invention occur not more than once every 250 milliseconds. Such use of static magnetic fields are known in the medical literature to produce beneficial effects within human flesh. It is believed that the instant invention is a considerably important discovery with considerable therapeutic benefit in preventing carpal tunnel syndrome and related maladies, and has healing effects for those that have hand, wrist and arm diseases such as arthritis.

Although the description above contains many specificities, these should not be construed as limiting the scope of the invention but as merely providing illustrations of some of the presently preferred embodiments of this invention. For example the wrist relaxer can have other shapes such as angular.

Thus the scope of the invention should be determined by the appended claims and their legal equivalents, rather than by the examples given.

We claim:

1. A support apparatus for use with a hand used equipment, the apparatus comprising;

a base having a length and a width defining a surface of the base;

a plurality of spaced apart end support members fixed to the surface of the base and extending upwardly therefrom;

a plurality of elongate, rod shaped rollers arranged in mutually parallel juxtaposition and rotationally engaged with the end support members, the rollers being positioned at a common height above the surface of the base, each of the rollers being adapted for free rotation about a longitudinal axis thereof;

each of the rod shaped rollers providing a cylindrical outer covering containing a ferromagnetic material, the outer covering being permanently magnetized so as to produce a static magnetic field having magnetic field lines extending in circumferential adjacency to the outer covering;

whereby with the support apparatus placed on a work surface, the rollers are in position for supporting the arms, wrists and bands in forward and backward thrusting movements therewith and for supporting the arms, wrists and hands in lateral sliding movements thereon, the forward and backward thrusting movements causing the arms, wrists and hands to move through magnetic field gradients between a magnetic north and a magnetic south positions on the rollers for therapeutic benefit.

* * * * *